US009704615B2

(12) United States Patent
Matsuda et al.

(10) Patent No.: US 9,704,615 B2
(45) Date of Patent: Jul. 11, 2017

(54) SHIELDED CABLE

(71) Applicant: SUMITOMO ELECTRIC INDUSTRIES, LTD., Osaka-shi, Osaka (JP)

(72) Inventors: Motoi Matsuda, Kanuma (JP); Katsumi Karube, Kanuma (JP); Yuto Kobayashi, Kanuma (JP); Takaki Endo, Kanuma (JP); Yoshiaki Arakawa, Kanuma (JP); Hayato Matsushita, Kanuma (JP)

(73) Assignee: SUMITOMO ELECTRIC INDUSTRIES, LTD., Osaka-shi, Osaka (JP)

( * ) Notice: Subject to any disclaimer, the term of this patent is extended or adjusted under 35 U.S.C. 154(b) by 0 days.

(21) Appl. No.: 14/951,626

(22) Filed: Nov. 25, 2015

(65) Prior Publication Data

US 2016/0155540 A1 Jun. 2, 2016

(30) Foreign Application Priority Data

Nov. 28, 2014 (JP) ..... 2014-240983

(51) Int. Cl.

| | |
|---|---|
| ***H01B 11/06*** | (2006.01) |
| ***H01B 3/00*** | (2006.01) |
| ***H01B 11/18*** | (2006.01) |
| *H01B 11/00* | (2006.01) |
| *H01B 11/20* | (2006.01) |

(52) U.S. Cl.

CPC ..... *H01B 3/004* (2013.01); *H01B 11/183* (2013.01); *H01B 11/002* (2013.01); *H01B 11/203* (2013.01)

(58) Field of Classification Search

CPC ..... H01B 11/06; H01B 11/02–11/05; H01B 11/07; H01B 11/08

USPC ..... 174/36, 106 R, 108, 109

See application file for complete search history.

(56) References Cited

U.S. PATENT DOCUMENTS 4,510,346 A * 4/1985 Bursh, Jr. ..... H01B 11/1016 174/106 R
6,984,788 B2 * 1/2006 Grogl ..... H01B 7/1895 174/106 R
9,214,260 B2 * 12/2015 Ishikawa ..... H01B 7/30

(Continued)

FOREIGN PATENT DOCUMENTS

JP 2014-017131 A 1/2014

*Primary Examiner* — Chau N Nguyen

(74) *Attorney, Agent, or Firm* — Drinker Biddle & Reath LLP

(57) ABSTRACT

A shielded cable comprising two insulated wire covered with first and second metal clad resin tapes each of which has a laminated metal layer and a resin layer. The first metal clad resin tape covers the circumference of the two insulated wires by open-wrapping and the second metal clad resin tape is spirally wrapped around the circumference of the first metal clad resin tape. The first and second metal clad resin tapes are disposed while the metal layers face each other and, in the portion where the second metal clad resin tape is overlapped by wrapping, the metal layer of the overlapped one second metal clad resin tape and the metal layer of the other second metal clad resin tape are in contact with the first metal clad resin tape. The shielded cable can prevent sharp signal attenuation in a high frequency region and is easy to bend and flexible.

6 Claims, 6 Drawing Sheets

(56) References Cited

U.S. PATENT DOCUMENTS

2003/0150633 A1* 8/2003 Hirakawa ..... H01B 11/002
174/36

* cited by examiner

SHIELDED CABLE

CROSS-REFERENCE TO RELATED APPLICATION

The present application claims the benefit of priority of Japanese Patent Application No. 2014-240983, filed on Nov. 28, 2014, which is incorporated herein by reference.

TECHNICAL FIELD

The present invention relates to a shielded cable and more specifically, it relates to a shielded cable in which a shielding conductor composed of a metal clad resin tape is applied onto the circumference of two or more insulated wires.

BACKGROUND ART

FIG. 11A and FIG. 11B are views showing a configuration of one example of a conventional shielded cable which is disclosed in Japanese patent publication 2014-17131A.

Two insulated wires (signal wires) 4 in which a signal conductor 2 composed of a twisted wire is covered with an insulator 3 having a predetermined dielectric constant are arranged in parallel. To the two insulated wires 4 arranged in parallel. On the outer circumference of the two insulated wires, a metal foil and resin tape 5 possessing a metal layer as a shielding conductor on one surface is wrapped. The metal clad resin tape 5 is wrapped spirally while a part thereof is overlapped. Another metal foil and resin tape 6 is spirally wrapped on the the metal foil and resin tape 5.

As mentioned above, in the case of the configuration where the metal clad resin tape 8 is wrapped as a shielding layer, sack-out, i.e., a dip of signal, is generated and has sometimes an influence on transmission characteristics of high frequency of 5 Gbps or more. The high frequency transmission characteristics can be improved by spirally wrapping two metal foil and resin tapes so that the metal foils are in contact with each other.

However, when the metal foil and resin tape is spirally wrapped in a state that a part thereof is overlapped, flexibility of the shielded cable is impaired.

SUMMARY OF THE INVENTION

The present invention has been made in the aforementioned circumstances and an object thereof is to provide a shielded cable having a shielding conductor applied onto the circumference of a plurality of insulated wires, which shielded cable prevents dip of signal in a high frequency region (referring "sack-out" hereinafter) and is easy to bend and flexible.

The shielded cable according to the invention is a shielded cable comprising two insulated wires covered with first and second metal clad resin tapes each having a configuration of laminated metal layer and resin layer, wherein the first metal clad resin tape covers the circumference of the two insulated wires by open-wrapping so that the first metal clad resin tape does not overlap each other, the second metal clad resin tape is spirally wrapped on the circumference of the first metal clad resin tape, and the first and second metal clad resin tapes are in contact with each other while the metal layers face each other and the metal layer of the first metal clad resin tape and the metal layer of the second metal clad resin tape are connected in a length direction of the cable.

According to the shielded cable of the invention, it is possible to provide a shielded cable having a shielding conductor applied onto the circumference of a plurality of insulated wires, which prevents dip of signal in a high frequency region and is easy to bend and flexible.

DETAILED DESCRIPTION

Details of Embodiment of Present Invention

Specific examples of the shielded cable according to the present invention will be described below with reference to Drawings. Incidentally, the invention is not limited to these illustrations and includes all changes which are shown by Claims and/or fall within meanings and ranges equivalent to Claims.

Figure 1A:
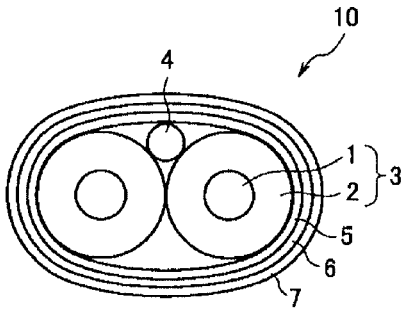
FIG. 1A and FIG. 1B are views showing a configuration according to one embodiment of the shielded cable according to the invention.
Figure 1B:
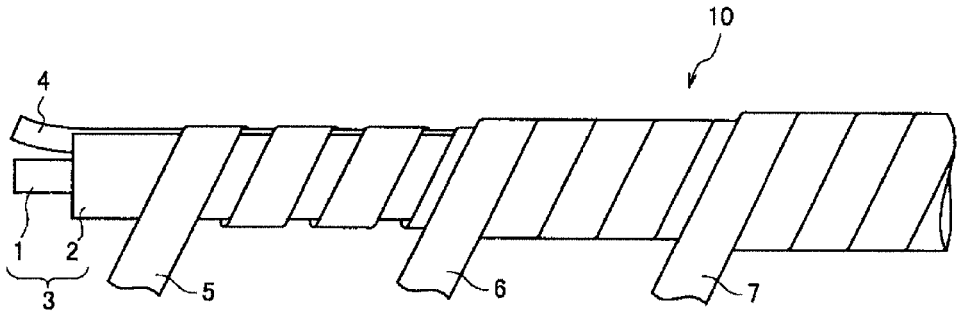

FIG. 1A and FIG. 1B are views showing a configuration according to one embodiment of the shielded cable according to the invention, FIG. 1A is a view showing a lamination configuration of the shield layers when an edge surface of the shielded cable is viewed from the front in the length direction, and FIG. 1B is a side view of the shielded cable. In the figures, 1 is a signal conductor, 2 is an insulator, 3 is an insulated wire, 4 is a drain wire, 5 is a first metal clad resin tape, 6 is a second metal clad resin tape, 7 is a resin tape, and 10 is a shielded cable.

As shown in FIG. 1A, the shielded cable 10 is formed of a pair cable in which two insulated wires (signal wires) 3 each having a signal conductor 1 composed of a single core wire or a twisted wire and covered with an insulator 2 having a predetermined dielectric constant are, for example, arranged in parallel. Alternatively the insulated wire 3 may be configured as a twist-pair wire in which the two insulated wires are twisted.

The signal conductor 1 is formed of a single core wire or a twisted wire of a good electric conductor such as copper or aluminum or one in which the good electric conductor is subjected to tin plating or the like and, for example, a wire material corresponding to AWG 24 to 34 (conductor crosssectional area of 0.02 $mm^2$ to 0.2 $mm^2$) is used. As the insulator 2 that electrically insulate the signal conductor 1, it is preferable to use a stable material which has a small dielectric constant as far as possible and is less susceptible to temperature and frequency and, for example, polyethylene (PE), polypropylene (PP), a fluororesin, or the like is used. The insulator 2 is configured as a solid insulator or a foamed insulator using the above material. The outer diameter of the insulated wire 3 formed of these signal conductor 1 and insulator 2 is, for example, from 0.5 to 2.2 mm.

To the two insulated wires 3, a drain wire 4 is longitudinally attached. The drain wire 4 is a cover-free conductor such as an annealed copper wire or a copper alloy wire and the thickness thereof is preferably the same as the diameter of the signal conductor 1 of the insulated wire 3 or a little smaller. Alternatively, a configuration using no drain wire 4 may be possible.

On the outer circumference of the paired two insulated wires 3, the first metal clad resin tape 5 is spirally wrapped (spiral wrapping) and the second metal clad resin tape 6 is spirally wrapped thereon, thereby configuring the shielding conductor. Here, the first metal clad resin tape 5 covers the circumference of the two insulated wires 3 by open-wrapping in which the first metal clad resin tape 5 is not overlapped and the second metal clad resin tape 6 is overlapped on the circumference of the first metal clad resin tape.

The interval of the open-wrapping of the first metal clad resin tape 5 is determined by the size of the insulated wire 3 and the width and the pitch of the tape. The open-wrapping is performed in a state that at least a space is present between the turns of the tape 5. When the pitch becomes large, production efficiency increases. The opening (or space) between the turns of the tape 5 is preferably from 1/10 to 1/2 of the width of the tape in the width direction of the wrapped tape.

The second metal clad resin tape 6 is wrapped on the circumference of the first metal clad resin tape 5 by spiral wrapping in which a part thereof is overlapped. The overlapped width of the tape is preferably from 1/6 to 1/2 of the tape width in the width direction of the wrapped tape. The wrapping direction of the spiral wrapping of the second metal clad resin tape 6 is not limited but is preferably the same direction as the wrapping direction of the wrapping of the first metal clad resin tape 5. Thereby, the metal layers of the first metal clad resin tape 5 and the second metal clad resin tape 6 can be surely contacted.

Moreover, in the example shown in the figure, the first and second metal clad resin tapes 5 and 6 are wrapped on the circumference of the two insulated wires 3 and the drain wire 4 but the drain wire 4 may be disposed between the first metal clad resin tape 5 and the second metal clad resin tape 6.

The first and second metal clad resin tapes 5 and 6 are all resin tapes whose one surface is a metal layer. More specifically, as the first and second metal clad resin tapes 5 and 6, there can be used one obtained by laminating a metal layer of an aluminum foil, a copper foil, or the like onto a resin substrate (resin tape) of polyethylene terephthalate (PET), polyethylene (PE), or the like having the same width as that of the metal layer. The thickness of the metal layer at this time is, for example, 3 μm or more and the thickness of the resin substrate is, for example, 3 μm or more. In addition, as the metal layer, a metal film obtained by vapor-depositing aluminum or copper onto the above resin substrate may be formed. The thickness of the metal film formed by vapor deposition is, for example, 0.05 μm or more.

Incidentally, since there is a concern of galvanic corrosion between different kinds of metals such as copper and aluminum, it is preferable to use the same kind of metal in the metal layers 5*b* and 6*b* of the first and second metal clad resin tapes 5 and 6. Here, the metal layers 5*b* and 6*b* are preferably formed of the same metal but a combination of metals causing no corrosion may be used.

Then, the resin tape 7 is spirally wrapped on the circumference of the second metal clad resin tape 6. The resin tape 7 is, for example, formed using a resin substrate of PET, PE, or the like, the width thereof being 1 mm or more and the thickness being 3 μm or more, and is wrapped at such a pitch that no opening remains between the turns of the tape when spirally wrapped. The wrapping direction of the spiral wrapping is not particularly limited.

Figure 2:
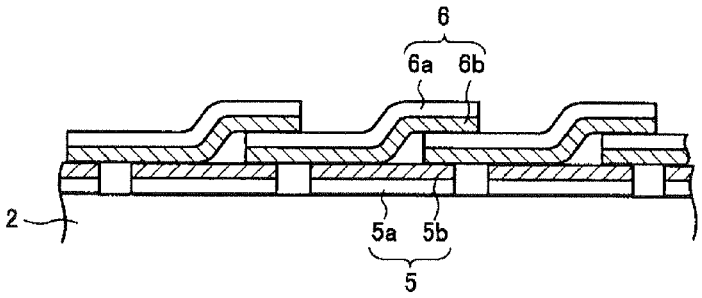
FIG. 2 is a view showing a disposition configuration of the first and second metal clad resin tapes in the embodiment of FIG. 1A and FIG. 1B.

FIG. 2 is a view showing a disposition configuration of the first and second metal clad resin tapes in the embodiment of FIG. 1A and FIG. 1B. The first metal clad resin tape 5 is formed by laminating the resin substrate 5*a* of PET, PE, or the like with the metal layer 5*b* composed of a foil of aluminum, copper, or the like or a vapor-deposited film. Similarly, the second metal clad resin tape is formed by laminating or vapor-depositing the resin substrate 6*a* with the metal layer 6*b*. In the laminated tape the thickness of the metal foil may be 3 μm or more, and the thickness of the resin tape may be 3 μm or more.

The first metal clad resin tape 5 is wrapped on the surface of the insulator 2 of the insulated wire by open wrapping. On this occasion, the first metal clad resin tape 5 is disposed so that the metal layer 5*b* of the tape 5 comes outside. Then, on the first metal clad resin tape 5, the second metal clad resin tape 6 is wrapped spirally so that a part thereof is overlapped. The second metal clad resin tape 6 is disposed so that the metal layer 6*b* comes inside. Thereby, the first and second metal clad resin tapes 5 and 6 are disposed while the metal layers 5*b* and 6*b* face each other. At the portion where the second metal clad resin tape 6 is overlapped, the metal layer 6*b* of the under-turn of the second metal clad resin tape 6 comes into contact with the metal layer 5*b* of the first metal clad resin tape 5. By this configuration, there is formed a shielding layer in which the metal layer 5*b* of the open-wrapped first metal clad resin tape 5 and the metal layer 6*b* of the overlapped second metal clad resin tape 6 are electrically connected. The metal layer 6*b* of the second metal clad resin tape 6 is also in contact with the drain wire.

By the above configuration, a double shielded wire using the first and second metal clad resin tape 5 and 6 as shielding layers can be configured and the high frequency transmission characteristics can be improved. Moreover, since the first metal clad resin tape 5 is wrapped at intervals by open-wrapping, the flexibility is secured in spite of the configuration where two layers of the metal clad resin tapes 5 and 6 are wrapped, and a shielded cable that is easy to bend and highly convenient can be obtained. Moreover, it is also possible to configure a multi-core cable having 1 pair to about 24 pairs by assembling a plurality of the shielded cables of the present embodiment.

Example 1

A sample was prepared according to the configuration described in FIG. 1A and FIG. 1B, and transmission characteristics were examined.

As for the configuration of the sample, two insulated wires 3 were arranged in parallel. Each of the insulated wire 3 had a diameter of 1.2 mm. An insulator 2 composed of foamed PE was provided around a signal conductor 1 corresponding to AWG 26, and thereby the insulated wire 3 was obtained.

The first metal clad resin tape 5 was formed by lamination of an aluminum foil and PET, and the thickness was 15 μm and the width was 4 mm. The second metal clad resin tape 6 was similarly formed by lamination configuration of an aluminum foil and PET, and the thickness was 15 μm and the width was 10 mm. The thickness of the metal foil was 9 μm.

Then, on the circumference of the insulated wire 3, the first metal clad resin tape 5 was wrapped spirally by open-wrapping while the metal layer thereof was positioned outside and furthermore, the second metal clad resin tape 6 was spirally overlapped on the circumference thereof. Here, the first metal clad resin tape 5 was open-wrapped so that a width of the opening was ⅙ width of the tape. The tape had a width of 4 mm, the opening was 0.67 mm, but since the tape is wrapped obliquely along the length direction of the wire, the opening between the tapes becomes 1 mm in the length direction of the wire. Moreover, the second metal clad resin tape 6 was overlapped so that ⅓ width of the tape was overlapped. The tape width was 4 mm, the overlapped width was 1.3 mm (but 1.5 mm along the length direction of the wire). In addition, the drain wire 4 was longitudinally attached between the first metal clad resin tape 5 and the second metal clad resin tape 6.

As the outermost resin tape 7, a PET tape having a thickness of 12 μm and a width of 9 mm was used. The resin tape was wrapped at a space of ⅓ and the wrapping pitch was 18 mm.

Also, for the purpose of comparison, a shielded cable was prepared. The shielded cable of comparative example had a configuration of the conventional example. Here, the insulated wire 3 had the same configuration as in the above Example 1, the drain wire 4 was longitudinally attached, and a single layer of a metal clad resin tape 8 was provided around it by overlapping. The metal clad resin tape 8 was formed by lamination configuration of an aluminum foil with PET, and the thickness was 15 μm and the width was 10 mm. The width of the overlapped portion was of ½ width of the tape about 5 mm). As the outermost resin tape 7, a PET tape having a thickness of 12 μm and a width of 9 mm was used. The wrapping pitch of the resin tape 7 was 8 mm and the width of the overlapped portion of the resin tape 7 was of ½ width of the tape (4 to 5 mm).

Figure 3:
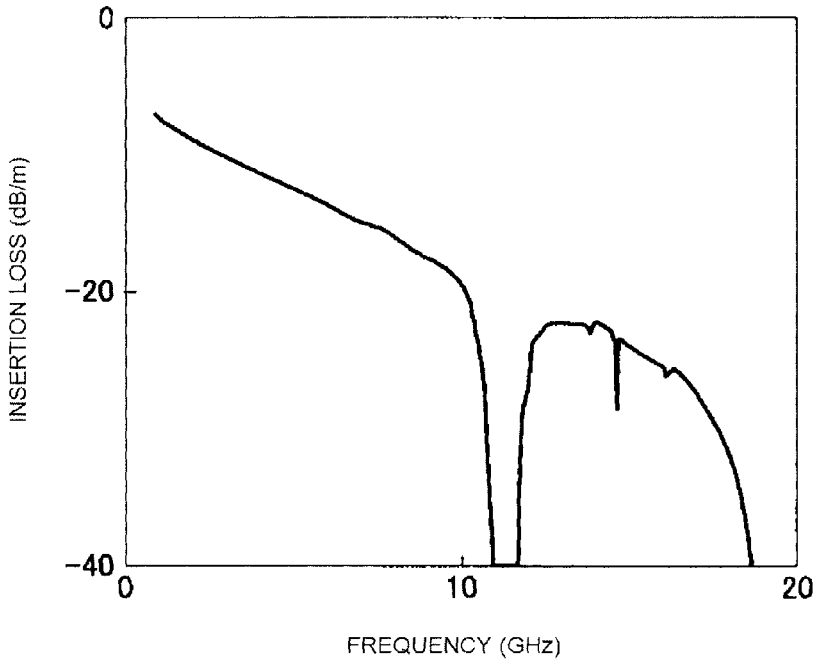
FIG. 3 is a view showing verification results of transmission characteristics in Comparative Example.
Figure 4:
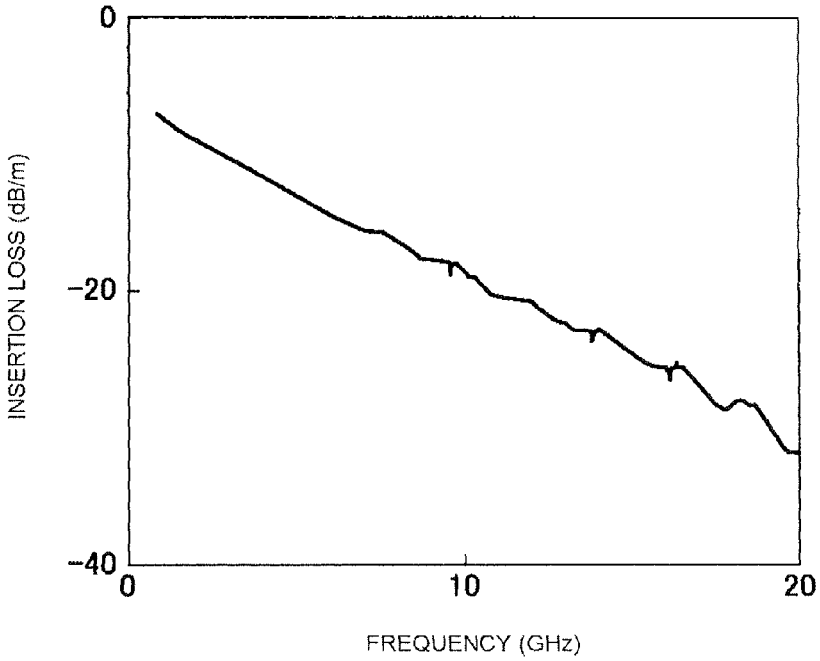
FIG. 4 is a view showing verification results of transmission characteristics in Example 1.

FIG. 3 and FIG. 4 are views showing verification results of transmission characteristics in the above Example 1 and Comparative Example and show characteristics of signal attenuation to frequency. FIG. 3 shows transmission characteristics of the conventional shielded cable according to Comparative Example. As shown in FIG. 3, a sack-out phenomenon occurs at around 10 to 12 GHz, where a signal drops.

Contrarily, as shown in FIG. 4, in the shielded cable according to Example 1 of the invention, the signal attenuation in the frequency direction from more than 0 to 20 GHz is gently sloping and such a sack-out phenomenon as that in Comparative Example does not occur.

In the configuration where one layer of a metal clad resin tape is wrapped as in Comparative Example, each metal layer of the upper and lower metal clad resin tapes is electrically insulated by the presence of the resin substrate at the portions where the metal clad resin tape 5 is overlapped vertically. Therefore, a shielding current flows spirally around the insulated wire 3.

On the other hand, in Example according to the invention, since the metal layer 6*b* of the overlapped second metal clad resin tape 6 is in contact with the metal layer 5*b* of the first metal clad resin tape 5 to be conducted therewith, the shielding current flows linearly in parallel to the insulated wires 3. Thereby, there is no influence of signal attenuation to be caused by the wrapping pitch of the metal clad resin tape, so that it is considered that the occurrence of the sack-out phenomenon can be prevented.

The following will describe second embodiment of the shielded cable according to the invention.

Figure 5A:
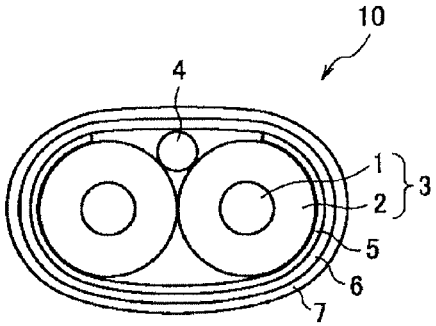
FIG. 5A and FIG. 5B are views showing a configuration according to another embodiment of the shielded cable according to the invention.
Figure 5B:
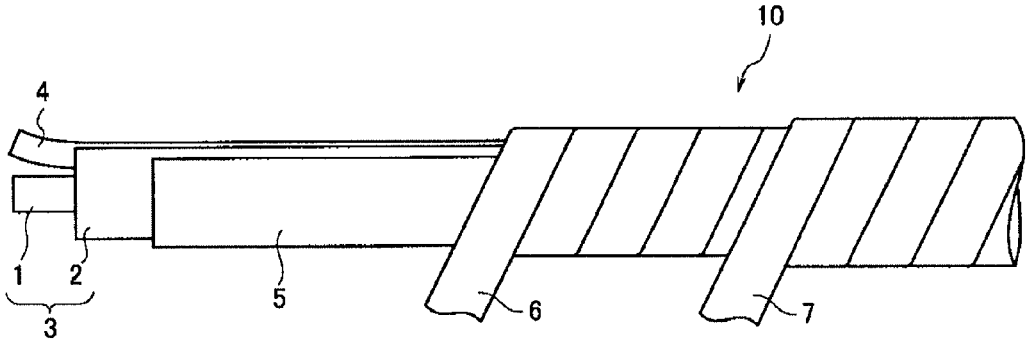

FIG. 5A and FIG. 5B are views showing a configuration according to another embodiment of the shielded cable according to the invention, FIG. 5A is a view showing a lamination configuration when an edge surface of the shielded cable is viewed from the front in the length direction, and FIG. 5B is a side view showing a lamination configuration. In the figures, 1 is a signal conductor, 2 is an insulator, 3 is an insulated wire, 4 is a drain wire, 5 is a first metal clad resin tape, 6 is a second metal clad resin tape, 7 is a resin tape, and 10 is a shielded cable.

As shown in FIG. 5A, the shielded cable 10 according to the present embodiment is formed of a pair cable in which two insulated wires 3 each having a signal conductor 1 composed of a single core wire or a twisted wire and covered with an insulator 2 having a predetermined dielectric constant are, for example, arranged in parallel.

The insulated wire 3 and the drain wire 4 are the same as in the first embodiment.

On the outer circumference of the paired two insulated wires 3, the first metal clad resin tape 5 is longitudinally attached. Here, the first metal clad resin tape 5 is longitudinally open-wrapped so as not to overlap the edge portions of the first metal clad resin tape 5 in the width direction of the first metal clad resin tape 5 each other. Then, the second metal clad resin tape 6 is spirally overlapped on the circumference of the first metal clad resin tape 5, thereby configuring a shielding conductor.

The interval between the edges of the open-wrapped first metal clad resin tape 5 is determined by the size of the insulated wire 3 and the width of the tape. The open-wrapping is performed in a state that at least a opening (or a space) is present between the edges of the tape. Here, when an covering ratio in the case where the two insulated wires are all covered is taken as 100%, the first metal clad resin tape 5 is preferably longitudinally wrapped so as to cover the two insulated wires 3 at an covering ratio of 50 to 100%, more preferably 60 to 90%.

When the occupying ratio of the first metal clad resin tape is less than 50%, the first metal clad resin tape 5 is likely to drop between the two insulated wires 3. When the covering ratio exceeds 100%, an overlapped portion of the first metal clad resin tape 5 covering the circumference of the insulated wires 3 are wrinkled, and deterioration of transmission characteristics is invited. By controlling the covering ratio to 60% or more, the drop of the first metal clad resin tape 5 can be more surely prevented. Also, by controlling the ratio to 90% or less, the drain wire 4 can be disposed in a space of open-wrapping of the first metal clad resin tape 5.

Figure 6:
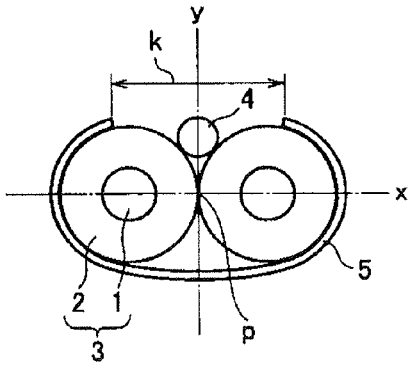
FIG. 6 is a view for explaining a disposition configuration of the first metal clad resin tape in the embodiment of FIG. 5A and FIG. 5B.

Furthermore, the first metal clad resin tape 5 is preferably provided so as to be bilaterally symmetrical, as shown in FIG. 6, the middle line between the two insulated wires 3 (a linear line represented by y in FIG. 6) being the center, when viewed at a cross-section perpendicular to the length direction of the wires. When the first metal clad resin tape 5 is provided asymmetrically, deterioration of the transmission characteristics is invited.

The second metal clad resin tape 6 is spirally wrapped on the circumference of the first metal clad resin tape 5 by overlapping so that a part thereof is overlapped. The wrapping direction of the second metal clad resin tape 6 is not particularly limited.

The drain wire 4 is provided at a space portion of the open-wrapped first metal clad resin tape 5 in the width direction (a portion at which the first metal clad resin tape 5 is not present) by longitudinal attaching. In this case, the drain wire 4 is brought into contact with the metal layer of the second metal clad resin tape 6 at the space portion of the first metal clad resin tape 5. Alternatively, the drain wire 4 may be disposed between the first metal clad resin tape 5 and the second metal clad resin tape 6.

The first and second metal clad resin tapes 5 and 6 are the same as in the first embodiment.

FIG. 6 is a view for explaining a disposition of the first metal clad resin tape in the embodiment of FIG. 5A and FIG. 5B. As mentioned above, in the present embodiment, the first metal clad resin tape 5 is preferably provided so that, the middle line between the two insulated wires 3 being the center, a cross-section thereof becomes bilaterally symmetrical. More specifically, as shown in FIG. 6, the first metal clad resin tape is wrapped on the insulated wires 3 by longitudinal wrapping so as to be linearly symmetrical to a symmetry axis y. The symmetry axis is a line that passes through a contact portion p of the two insulated wires and is orthogonal to the arranging direction of the two insulated wires 3. The region k where the first metal clad resin tape 5 is opened by open-wrapping is provided linearly symmetrically with respect to the symmetry axis y.

Thus, by longitudinally attaching the first metal clad resin tape 5 so as to be symmetrical to the portion where the insulated wires 3 are in contact with each other, the deterioration of transmission characteristics of the shielded cable can be prevented.

When the first metal clad resin tape 5 is disposed at a position deviated from the above symmetrical position, the transmission characteristics may be deteriorated, and therefore symmetrical disposition is preferred.

Figure 7:
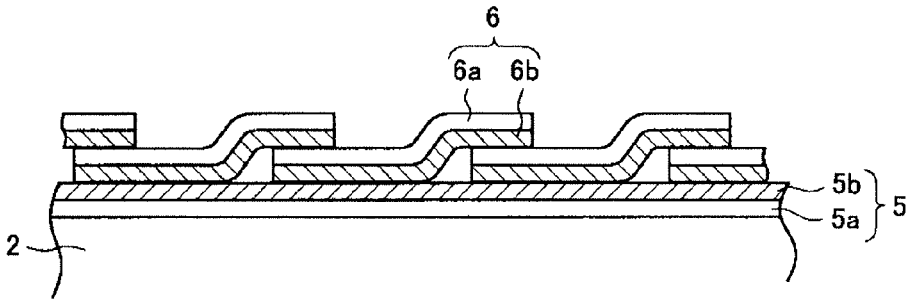
FIG. 7 is a view showing a lamination configuration of the first and second metal clad resin tapes in the embodiment of FIG. 5A and FIG. 5B.

FIG. 7 is a view showing a lamination configuration of the first and second metal clad resin tapes in the embodiment of FIG. 5A and FIG. 5B. The first metal clad resin tape 5 is formed by laminating the resin substrate 5*a* of PET, PE, or the like with the metal layer 5*b* composed of a foil of aluminum, copper, or the like or a vapor-deposited film. Similarly, the second metal clad resin tape is formed by laminating the resin substrate 6*a* with the metal layer 6*b*.

The first metal clad resin tape 5 is longitudinally wrapped on the surface of the insulator 2 of the insulated wire by open-wrapping. At this time, the first metal clad resin tape 5 is disposed so that the metal layer 5*b* of the tape 5 comes outside.

Then, on the first metal clad resin tape 5, the second metal clad resin tape 6 is spirally overlapped so that a part thereof is overlapped. The second metal clad resin tape 6 is disposed so that the metal layer 6*b* comes inside. Thereby, the first and second metal clad resin tape 5 and 6 are disposed while the metal layers 5*b* and 6*b* face each other and the metal layer 6*b* of the second metal clad resin tape 6 comes into contact with the metal layer 5*b* of the first metal clad resin tape 5. By this configuration, there is formed a shielding layer in which the metal layer 5*b* of the longitudinally open-wrapped first metal clad resin tape 5 and the metal layer 6*b* of the overlapped second metal clad resin tape 6 are electrically connected. The metal layer 6*b* of the second metal clad resin tape 6 is also in contact with the drain wire.

By the above configuration, a double shielded wire using the first and second metal clad resin tape 5 and 6 as shielding layers can be configured and the high frequency transmission characteristics of a shielded cable can be improved. Moreover, since the first metal clad resin tape 5 is longitudinally wrapped by open-wrapping, the flexibility is secured in spite of the configuration where two layers of the metal clad resin tapes 5 and 6 are wrapped, and a shielded cable that is easy to bend and handle can be obtained. Moreover, the contact of the drain wire with the shielding layer can be secured. It is also possible to configure a multi-core cable having 1 pair to about 24 pairs by assembling a plurality of the shielded cable of the present embodiment.

Example 2

Samples were prepared according to the configuration described in FIG. 5A and FIG. 5B, and transmission characteristics were examined.

As for the configuration of the sample, two insulated wire 3 were arranged in parallel. Each of the insulated wire 3 had a diameter of 1.2 mm. An insulator 2 composed of foamed PE was provided around a signal conductor 1 corresponding to AWG 26, and thereby the insulated wire 3 was obtained. The first metal clad resin tape 5 was formed by lamination of an aluminum foil and PET, and the thickness was 15 μm and the width was 4 mm. The second metal clad resin tape 6 was similarly formed by lamination configuration of an aluminum foil and PET, and the thickness was 15 μm and the width was 10 mm. The thickness of the metal foil was 9 μm.

Then, on the circumference of the insulated wire 3, the first metal clad resin tape 5 was wrapped spirally by open-wrapping while the metal layer thereof was positioned outside and furthermore, the second metal clad resin tape 6 was wrapped on the circumference thereof by overlapping. The second metal clad resin tape 6 was spirally overlapped so that 30% width of the tape was overlapped. In addition, the drain wire 4 was longitudinally attached between the first metal clad resin tape 5 and the second metal clad resin tape 6. As the outermost resin tape 7, a PET tape having a thickness of 12 μm and a width of 9 mm was used and the wrapping pitch was 14 mm. The resin tape was spirally wrapped so that 30% width of the tape was overlapped.

With the above configuration, three kinds of trial products were prepared with changing the width of the first metal clad resin tape 5 and thus changing the covering ratio. Specifically, the width of the first metal clad resin tape 5 was changed to three kinds of 4 mm, 5 mm, and 6 mm. The covering ratio is 65% when the width of the first metal clad resin tape is 4 mm, the covering ratio is 81% when the width is 5 mm, and covering ratio reaches 97% when the width is 6 mm. At this time, in the trial product having an covering ratio of 65%, the first metal clad resin tape 5 was provided so that, the middle line between the two insulated wires 3 being the center, a cross-section thereof becomes bilaterally symmetrical. Moreover, in the trial product having an covering ratio of 81%, the first metal clad resin tape 5 was disposed in a largely deviated state from the above bilaterally symmetrical form. Furthermore, in the trial product having an covering ratio of 97%, the first metal clad resin tape 5 was disposed in a slightly deviated state from the above bilaterally symmetrical form.

Figure 8:
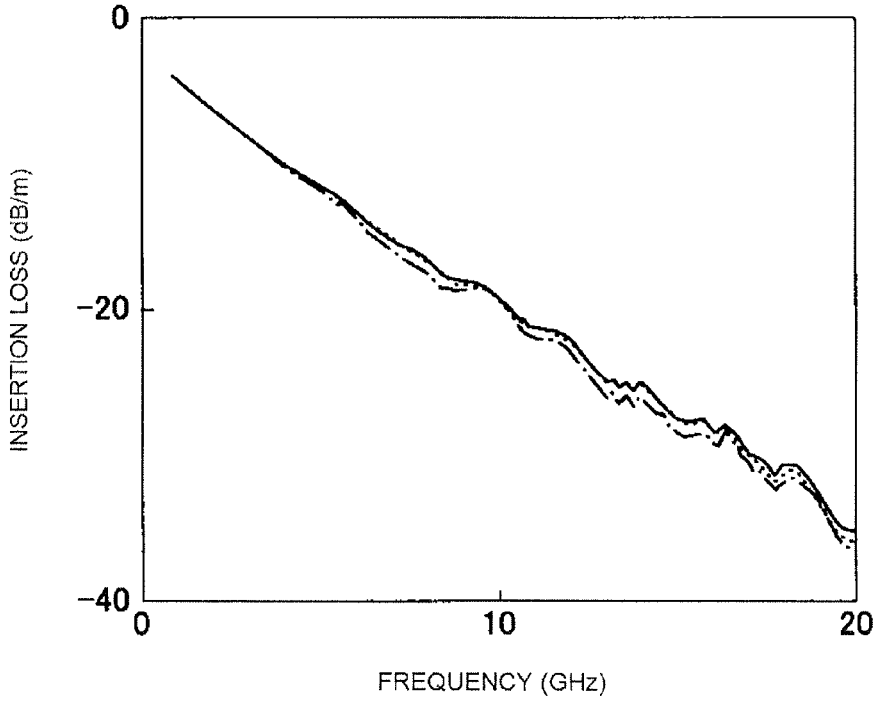
FIG. 8 is a view showing verification results of transmission characteristics in Example 2.
Figure 9:
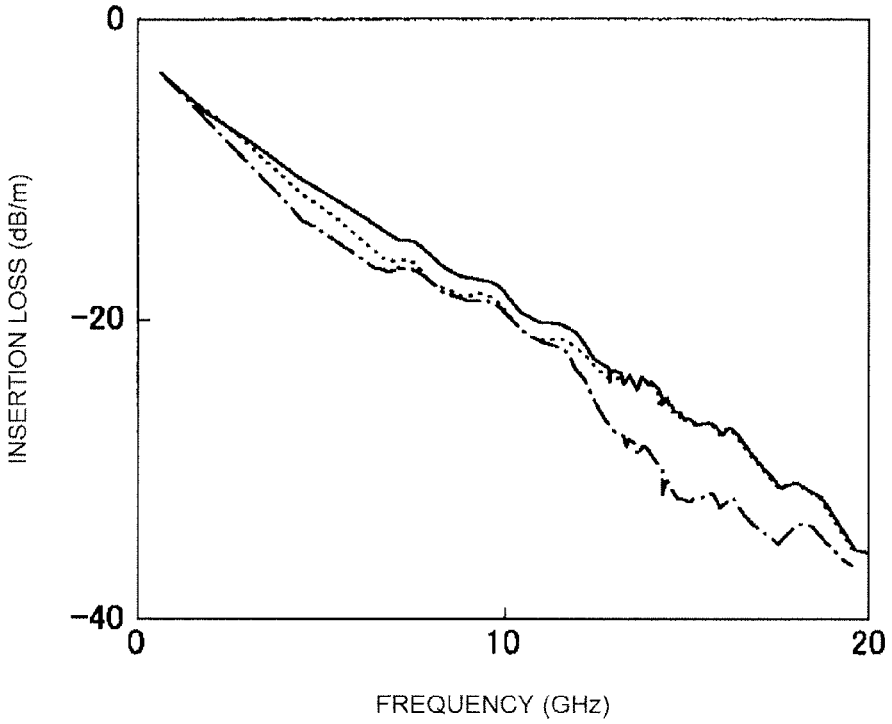
FIG. 9 is a view showing other verification results of transmission characteristics in Example 2.
Figure 10:
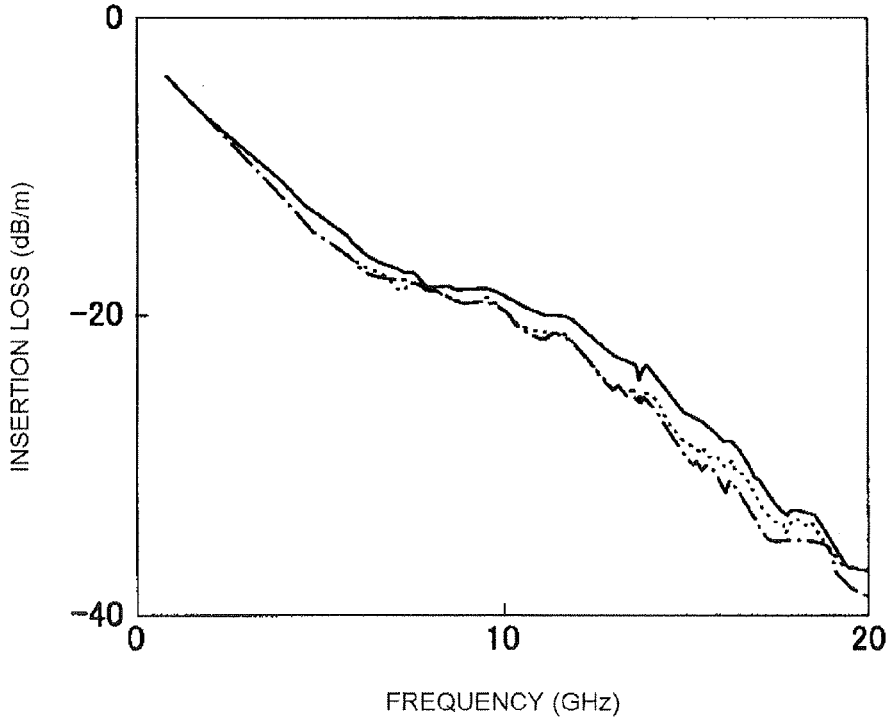
FIG. 10 is a view showing still other verification results of transmission characteristics in Example 2.
Figure 11A:
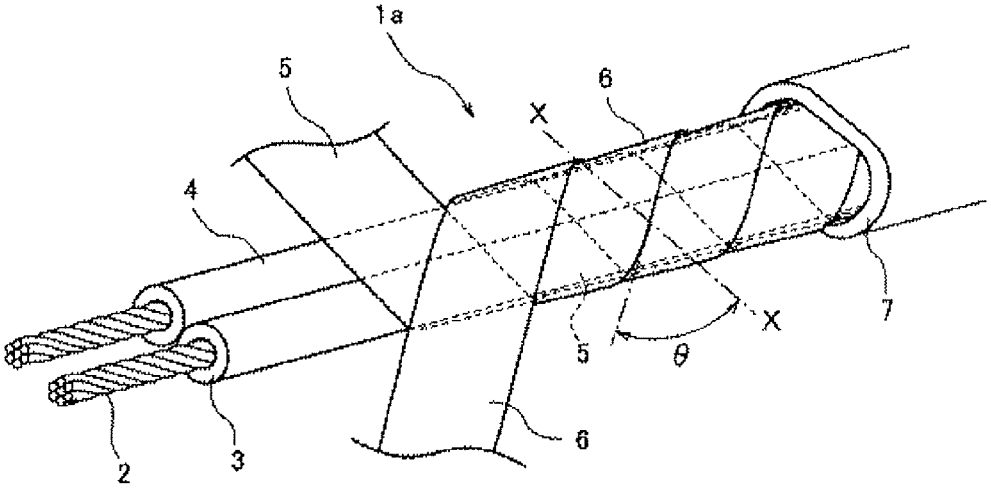
FIG. 11A PRIOR ART
FIG. 11A and FIG. 11B are views showing a configuration of one example of a conventional shielded cable.
Figure 11B:
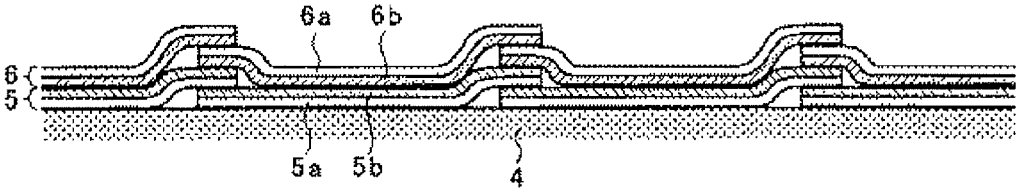
FIG. 11B PRIOR ART

FIG. 8 to FIG. 10 are views showing verification results of transmission characteristics in the above Example 2 and show characteristics of insertion loss of a signal to frequency. In the figures, insertion loss for each pair was shown. FIG. 8 shows transmission characteristics of the sample in which the first metal clad resin tape 5 was bilaterally symmetrically disposed at an covering ratio of 65%, FIG. 9 shows transmission characteristics of the sample in which the first metal clad resin tape 5 was disposed at an covering ratio of 81% in a largely deviated state from bilateral symmetry, and FIG. 10 shows transmission characteristics of the sample in which the first metal clad resin tape 5 was disposed at an covering ratio of 97% in a slightly deviated state from bilateral symmetry. In each sample, three shielded cable were prepared and transmission characteristics thereof and variation were examined by measuring characteristics of signal attenuation to frequency for each of them.

As shown in FIG. 8 to FIG. 10, in each sample, the signal attenuation to the frequency is gently sloping and such a sack-out phenomenon that a signal sharply drops does not occur. In the sample in which the first metal clad resin tape 5 is bilaterally symmetrically provided, as shown in FIG. 8, variation in the characteristics between a plurality of trial products is small and stable high frequency characteristics are shown.

On the other hand, as shown in FIG. 9, in the samples in which the first metal clad resin tape 5 was disposed in a largely deviated state from bilateral symmetry, variation was observed between individual samples. In addition, as shown in FIG. 10, in the sample in which the first metal clad resin tape 5 was disposed in a slightly deviated state from bilateral symmetry, variation in the transmission characteristics was observed between individual samples although the degree of variation was smaller than the variation in the transmission characteristics in FIG. 9.

In the present Example, since the metal layer 6*b* of the overlapped second metal clad resin tape 6 is in contact with the metal layer 5*b* of the first metal clad resin tape 5 to be conducted therewith, the shielding current flows linearly in parallel to the insulated wires 3. Thereby, there is no influence of signal attenuation to be caused by the wrapping pitch of the metal clad resin tape, so that it is considered that the occurrence of the sack-out phenomenon can be prevented.

The first metal clad resin tape 5 is preferably disposed at bilaterally symmetrical position to the center line between them in a cross-section. When it is deviated from the bilaterally symmetrical state, variation in the transmission characteristics occurs. For example, in the case where a multi-core cable is prepared by assembling a plurality of shielded cables, variation in the transmission characteristics occurs between the shielded cables in the cable and thus is not preferred. That is, in the present embodiment, the symmetry of the first metal clad resin tape 5 becomes important.

By the above configuration, the transmission characteristics of a shielded cable can be improved. Also, since the first metal clad resin tape 5 is wrapped by longitudinally open-wrapping, flexibility of the cable is secured in spite of the configuration where two layers of the metal clad resin tapes 5 and 6 are wrapped, and a shielded cable that is easy to bend and handle can be obtained.

The invention claimed is:

1. A shielded cable comprising two insulated wires covered with first and second metal clad resin tapes each having a configuration of laminated metal layer and resin layer, wherein the first metal clad resin tape covers the circumference of the two insulated wires by open-wrapping so that a turn of the first metal clad resin tape does not overlap each other, the second metal clad resin tape is spirally wrapped around the circumference of the first metal clad resin tape so that a part of the second metal clad resin tape is overlapped with each other and another part of the second metal clad resin tape is not overlapped with each other, the first and second metal clad resin tapes are in contact with each other while the metal layers thereof face each other and the metal layer of the first metal clad resin tape and the metal layer of the second metal clad resin tape are connected in a length direction of the cable, a drain wire consisting of a cover-free conductor is attached to the two insulated wires, and the metal layer of the second metal clad resin tape is in contact with the drain wire.

2. The shielded cable according to claim 1, wherein the first metal clad resin tape is spirally open-wrapped.

3. The shielded cable according to claim 2, wherein the wrapping direction of the first metal clad resin tape is the same as that of the second metal clad resin tape.

4. The shielded cable according to claim 1, wherein the first metal clad resin tape is provided by longitudinal wrapping and is open-wrapped so that the edge portions of the first metal clad resin tape in a width direction do not overlap each other.

5. The shielded cable according to claim 4, wherein the first metal clad resin tape is disposed in a cross section perpendicular to a long direction of the cable so as to be linearly symmetrical to symmetry axis which is a line that passes through a contact portion of the two insulated wires and is orthogonal to the arranging direction of the two insulated wires.

6. The shielded cable according to claim 4, wherein, when a covering ratio in the case where the two insulated wires are all covered in the circumferential direction is taken as 100%, the first metal clad resin tape is longitudinally wrapped so as to cover the two insulated wires at a covering ratio of 50 to less than 100%.

* * * * *